US009587445B2

(12) United States Patent
Dalrymple et al.

(10) Patent No.: US 9,587,445 B2
(45) Date of Patent: Mar. 7, 2017

(54) DELTA-SHAPED POWER CABLE WITHIN COILED TUBING

(71) Applicant: Baker Hughes Incorporated, Houston, TX (US)

(72) Inventors: Larry V Dalrymple, Claremore, OK (US); David H. Neuroth, Clayton, NY (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 14/444,520

(22) Filed: Jul. 28, 2014

(65) Prior Publication Data

US 2015/0030480 A1 Jan. 29, 2015

Related U.S. Application Data

(60) Provisional application No. 61/859,555, filed on Jul. 29, 2013.

(51) Int. Cl.

| | |
|---|---|
| ***F04D 13/10*** | (2006.01) |
| ***E21B 17/20*** | (2006.01) |
| ***E21B 43/12*** | (2006.01) |
| ***F04D 13/06*** | (2006.01) |
| *H01B 7/04* | (2006.01) |

(52) U.S. Cl.

CPC ..... *E21B 17/206* (2013.01); *E21B 43/128* (2013.01); *F04D 13/0693* (2013.01); *F04D 13/10* (2013.01); *H01B 7/046* (2013.01)

(58) Field of Classification Search

CPC .. E21B 17/206; E21B 43/128; F04D 13/0693; F04D 13/10; H01B 7/0045; H01B 9/006

See application file for complete search history.

(56) References Cited

U.S. PATENT DOCUMENTS

| | | | | |
|---|---|---|---|---|
| 4,681,169 | A * | 7/1987 | Brookbank, III | E21B 17/1035 166/385 |
| 5,146,982 | A * | 9/1992 | Dinkins | E21B 17/206 166/65.1 |
| 5,191,173 | A | 3/1993 | Sizer et al. | |
| 5,920,032 | A | 7/1999 | Aeschbacher et al. | |
| 5,974,226 | A * | 10/1999 | Shaffer | E21B 17/206 166/302 |
| 6,143,988 | A * | 11/2000 | Neuroth | E21B 17/1085 138/113 |

(Continued)

OTHER PUBLICATIONS

PCT Search Report mailed Feb. 2, 2016—S.N. PCT/US2014/048534, Filed Jul. 29, 2014.

*Primary Examiner* — Patrick Hamo

(74) *Attorney, Agent, or Firm* — Bracewell LLP; James E. Bradley

(57) ABSTRACT

A power cable assembly supplies power to and suspends in a well an electrical well pump. The assembly includes metal tubing having a longitudinal tubing center line and a cylindrical side wall. Power cable has an exterior delta shape when viewed in a cross-section. The delta shape defines three exterior side surfaces that face radially outward and join each other at corners. Power cable has three insulated power conductors wrapped helically with a metal strip. The power cable is located in the tubing with the corners deformed against an inner diameter of the tubing.

19 Claims, 3 Drawing Sheets

(56) References Cited

U.S. PATENT DOCUMENTS

| | | | | |
|---|---|---|---|---|
| 6,260,615 | B1 * | 7/2001 | Dalrymple | E21B 36/04 166/302 |
| 6,397,945 | B1 | 6/2002 | Manke | |
| 6,585,046 | B2 * | 7/2003 | Neuroth | E21B 36/04 166/302 |
| 6,695,062 | B2 * | 2/2004 | Dalrymple | E21B 23/14 166/380 |
| 7,611,339 | B2 * | 11/2009 | Tetzlaff | E21B 43/128 166/65.1 |
| 7,849,928 | B2 | 12/2010 | Collie | |
| 7,905,295 | B2 | 3/2011 | Mack | |
| 2004/0163801 | A1 | 8/2004 | Dalrymple | |
| 2016/0047210 | A1 * | 2/2016 | Pinkston | E21B 17/206 166/66.4 |

* cited by examiner

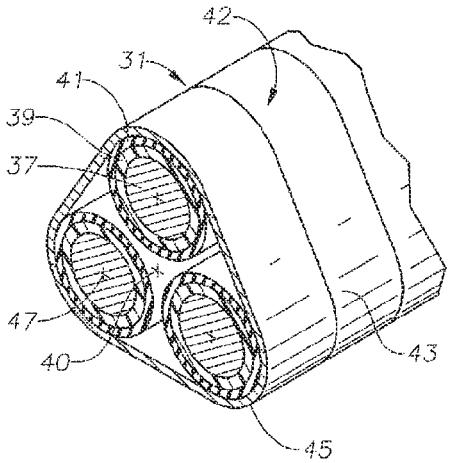
FIG. 3
FIG. 4
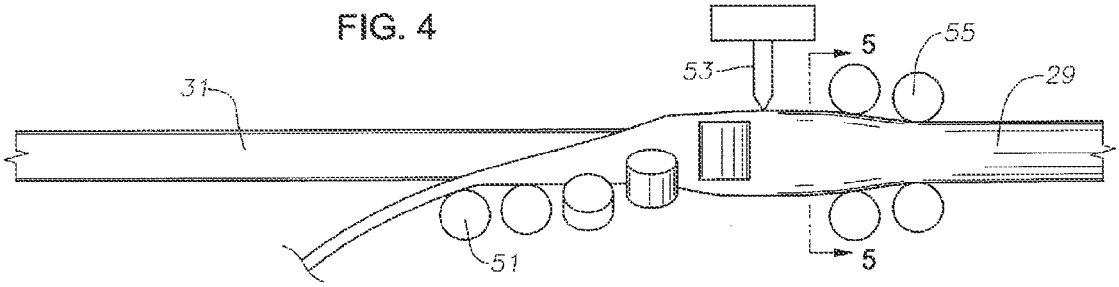

DELTA-SHAPED POWER CABLE WITHIN COILED TUBING

CROSS REFERENCE TO RELATED APPLICATION

This application claims priority to provisional application Ser. No. 61/859,555, filed Jul. 29, 2013.

FIELD OF THE DISCLOSURE

This disclosure relates in general to electrical submersible pumps for wells and in particular to a motor power cable having a delta cross section and enclosed within coiled tubing.

BACKGROUND

Electrical submersible pumps (ESP) are often used to pump fluids from hydrocarbon wells. An ESP includes a motor, a pump, and a seal section that reduces a pressure differential between well fluid on the exterior and dielectric lubricant in the motor interior. An ESP may have other components, such as a gas separator or additional pumps, seal sections and motors in tandem.

A power cable extends from the surface to the motor for supplying three-phase power. Usually, the power cable has three conductors, each of which is separately insulated. A single elastomeric jacket is extruded over the three insulated conductors. A metal strip is wrapped around the jacket. In round cable, the jacket is round in cross-section. In most cases, a string of production tubing supports the ESP, and bands secure the power cable to and alongside the production tubing. When the ESP has to be retrieved for repair or replacement, a workover rig is required to pull the tubing along with the power cable and ESP.

It is desirable to avoid having to employ a workover rig to retrieve the ESP. However, a conventional power cable cannot support its own weight in many wells, thus needs additional support. One technique involves placing the power cable within coiled tubing, which is a continuous length of metal tubing deployed from a reel. The pump discharges up an annular space surrounding the coiled tubing.

Various methods have been proposed and employed to transfer the weight of the power cable to the coiled tubing. In one method, the power cable is pulled through the coiled tubing after the coiled tubing. Various standoffs or dimples formed in the coiled tubing anchor the power cable within the coiled tubing. In another method, the power cable is placed in the coiled tubing as the coiled tubing is being formed and seam welded.

SUMMARY

The electrical submersible well pump assembly of this disclosure includes a pump driven by an electrical motor. A string of coiled tubing connects to the well pump assembly and extends to an upper end of a well to support the pump and motor in the well. A power cable with three insulated power conductors twisted about each other has a polygonal shape in cross-section. The polygonal shape defines a plurality of exterior side surfaces that face radially outward relative to the power cable center line. The side surfaces join each other at rounded corners, and have equal widths. The power conductor is located in the coiled tubing with the corners deformed against an inner diameter of the coiled tubing.

In the preferred embodiment, there are three exterior side surfaces. Each corner forms a 60 degree angle between two of the side surfaces. Each of the exterior side surfaces of the power cable is generally flat. The polygonal shape in cross section defines an equilateral triangle. Each of the conductors has a conductor center line. A first radial line from the power cable center line passes through the conductor center line of a first one of the conductors and through a first one of the corners. A second radial line from the power cable center line passes through the conductor center line of a second one of the conductors and through a second one of the corners. A third radial line from the power cable center line passes through the conductor center line of a third one of the conductors and through a third one of the corners. Preferably, the power cable includes a metal strip is wrapped around the twisted conductors.

After the power cable is installed in the coiled tubing, the coiled tubing will have a final inner diameter. Prior to installing the power cable in the coiled tubing, the power cable circumscribes an outer diameter greater than the final inner diameter of the coiled tubing.

In one embodiment, an adhesive material fills spaces between the exterior side surfaces and the inner diameter of the coiled tubing. The adhesive may be an epoxy.

BRIEF DESCRIPTION OF THE DRAWINGS

FIG. 3 is a perspective view of a portion of the power cable shown separate from the coiled tubing.

FIG. 4 is schematic view of the coiled tubing being formed and welded around the power conductors of FIG. 2.

DETAILED DESCRIPTION OF THE DISCLOSURE

Figure 1:
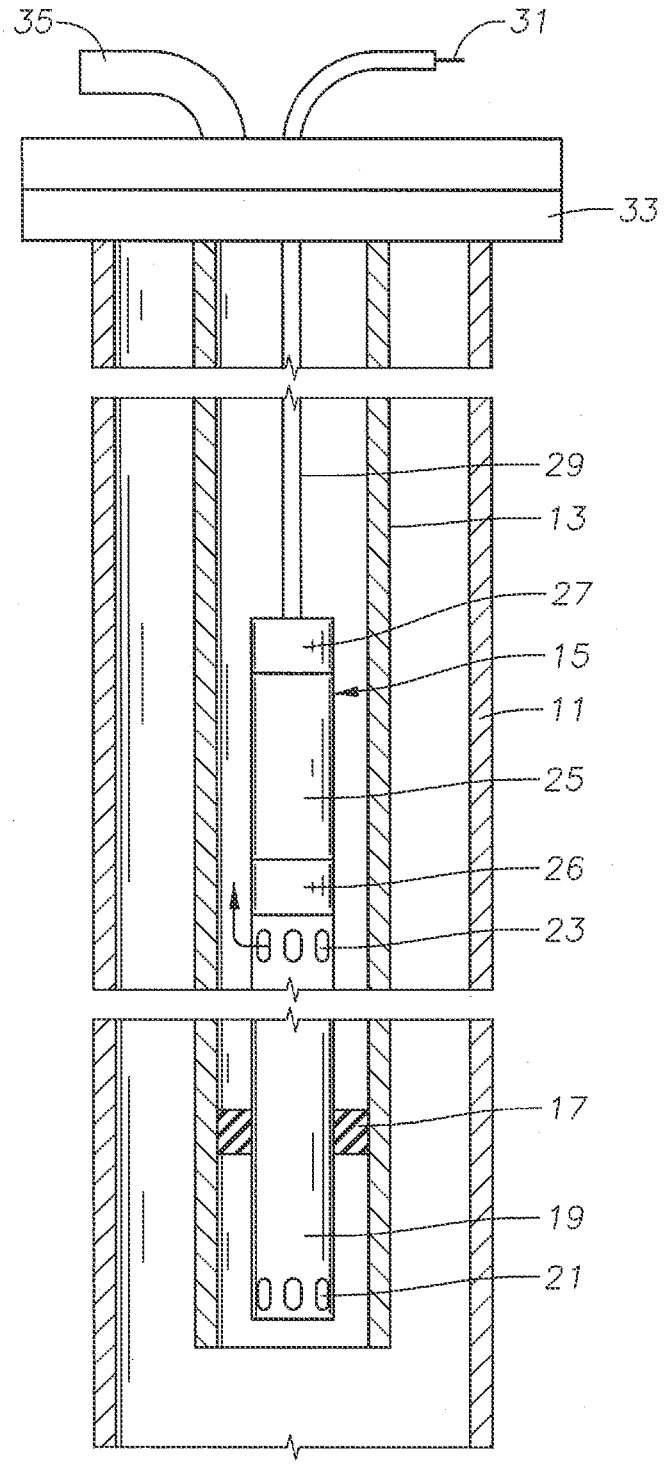
FIG. 1 is a schematic view of an electrical submersible pump assembly supported by coiled tubing containing a power cable in accordance with this disclosure.

Referring to FIG. 1, the well includes casing 11, which will be cemented in place. In the embodiment shown, a tubular liner 13 extends through the casing 11. Liner 13, which serves as production tubing, is of a conventional type, having sections secured together by threads. Liner 13 is not cemented in the well. An electrical pump assembly (ESP) 15 is supported inside liner 13. A packer 17 supports ESP 15 in liner 13 and seals the annulus around ESP 15. Typically, ESP 15 has a stinger (not shown) on its lower end that slides into a polished bore in packer 17.

ESP 15 includes a centrifugal pump 19 of conventional design. Alternately, pump 19 could be another type of pump, such as a progressing cavity pump. In this example, pump 19 has a lower end located below packer 17. Pump 19 has intake ports 21 below packer 17 and discharge ports 23 located above packer 17 for discharging well fluid pumped from the well. Packer 17 seals the annulus between ESP 15 and liner 13, and pump 19 draws well fluid from below packer 17 and discharges it into the annulus above packer 17.

An electrical motor 27 is coupled to a seal section 25, which in turn connects to pump 19. Seal section 25 has components to reduce a pressure differential between lubricant contained in motor 27 and the well fluid. A shaft (not shown) extends from motor through seal section 25 and into pump 19 to rotate pump 19. The upper end of motor 27 has an adapter (not shown), which may be of various types, and serves as means for securing ESP 15 to a lower end of a length of coiled tubing 29.

Coiled tubing 29 contains a power cable 31 for motor 27 and also supports the weight of power cable 31 and ESP 15 while ESP 15 is being lowered into the well. Although motor 27 is shown mounted above seal section 25 and pump 19, the assembly could be inverted with motor 27 at the lower end.

Coiled tubing 29 is metal, flexible tubing of a type that will be coiled on a reel (not shown) located at the surface before ESP 15 is deployed. Motor 27 is of conventional design and typically is a three phase motor. A production tree 33 at the upper end of casing 11 provides pressure and flow control. A flow line 35 extends from tree 33 for delivering well fluids pumped by ESP 15.

Figure 2:
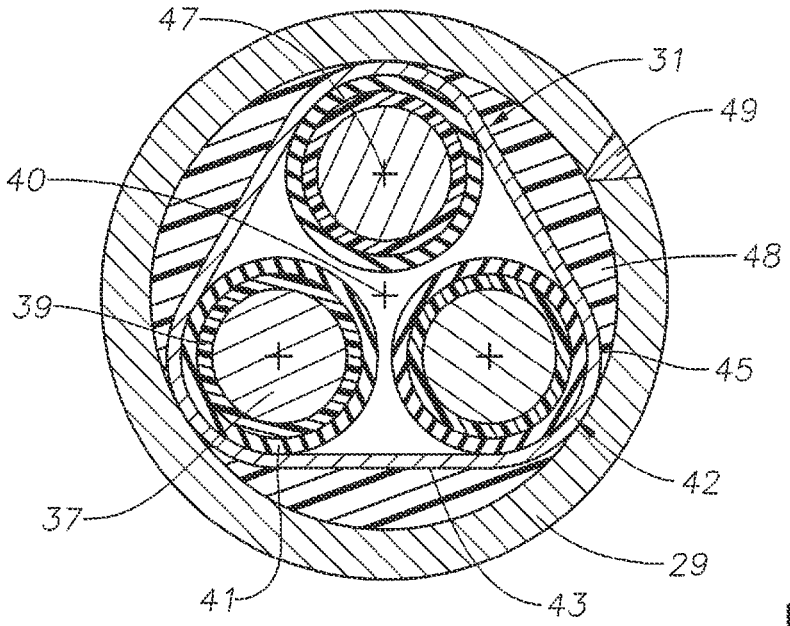
FIG. 2 is a cross sectional view of one embodiment of the power cable of the pump assembly of FIG. 1.

Referring to FIG. 2, power cable 31 includes three electrical conductors 37 for delivering power to motor 27. Each conductor 37 is of electrically conductive material, such as copper. At least one electrical insulation layer 39 surrounds each conductor 37. A separate elastomeric jacket 41, also of a conventional material, surrounds each of the three insulated conductors 37. Each jacket 41 may be either electrically conductive or electrically non-conductive, and it may have longitudinally extending grooves or ridges (not shown) on its exterior. Each insulation layer 39 and jacket 41 has a cylindrical exterior. Jacket 41 is typically thinner than insulation layer 39. For example, jacket 41 may have a thickness of about 0.040 inch and insulation layer 39 a thickness of about 0.090 inch. Insulation layer 39 and jacket 41 may be of a variety of conventional polymeric insulation materials. Suitable materials include the following: EPDM (ethylene propylene dienne monomer), nitrile rubber, HNBG rubber, aflas rubber, FKM rubber, polypropylene (PP), polyethylene (PE), cross-linked PE or PP, thermoplastic elastomers, fluoropolymers, thermoplastics or thermoset elastomers.

Insulated conductors 37 are twisted about each other along a power cable center line 40. At any point, when viewed in a cross-section perpendicular to power cable center line 40, insulated conductors 37 will appear oriented 120 degrees apart from each other. The twisting of insulated conductors 37 enables power cable 31 to be rolled onto a reel.

Power cable 31 includes a metal band or strip 42 wrapped around the twisted three insulated conductors 37. As shown also in FIG. 3, metal strip 42 is wrapped helically about the twisted insulated conductors 37. The side edges of metal strip 42 overlap each other to fully enclose insulated conductors 37. Metal strip 42 defines a triangular or delta-shaped configuration for power cable 31, when viewed in cross section, with three generally flat sides 43 joined by three rounded tips or corners 45. Flat sides 43 could be rounded in a convex fashion and need not be truly flat. Preferably, the exterior of metal strip 42 defines an equilateral triangle, having equal 60 degree angles between each of its flat sides 43. Corners 45 are 120 degrees apart from each other relative to power cable center line 40 and deformed against the inner diameter of coiled tubing 29. The initial diameter circumscribed by a circle tangent to each corner 45 is greater than the final inner diameter of coiled tubing 29 when it is ready to be deployed. Each rounded corner 45 has a radius equal to a radius of each jacket 41.

Metal strip 42 is preferably thinner than jackets 41 and insulations layers 39, such as 0.003 to 0.005 inches in thickness, and may be a variety of metals, such as copper, aluminum or steel. Metal strip 42 will be in frictional contact with the inner diameter of coiled tubing 29 at corners 45. Flat exterior sides 43 of metal strip 42 are spaced from the inner diameter of coiled tubing 29.

Conductors 37 are arranged in a triangular pattern; that is each conductor geometric center line 47 is located on a separate radial line emanating from power cable center line 40. Each radial line passes through one of the conductor center lines 47 and through one of the corners 45. Conductor center lines 47 are spaced 120 degrees apart from each other relative to power cable center line 40. Power cable center line 40 coincides with the center line of coiled tubing 29. The separate jackets 41 may touch each other near power cable center line 40.

Power cable 31 typically will not support its own weight within an oil producing well because of the long length. The friction created by corners 45 being deformed against the inner diameter of coiled tubing 29 may be adequate in some wells to transfer the weight of power cable 31 to coiled tubing 29. Alternatively, an adhesive such as epoxy 48 may be pumped through the three channels or spaces between flat sides 43 and coiled tubing 29. Once cured, epoxy 48 will provide adequate bonding friction between jacket 41 and coiled tubing 29 to support the weight of power cable 31.

Power cable 31 can be formed and pulled into coiled tubing 29 after both have been manufactured. Alternately, power cable 31 can be formed, then installed in coiled tubing 29 while coiled tubing 29 is being manufactured, particularly if manufactured of an alloy such as 316L stainless steel or a similar material. When power cable 31 is installed during manufacturing, coiled tubing 29 is rolled from a flat strip into a cylindrical shape, and a weld is made of the abutting edges, as shown by weld seam 49.

FIG. 4 schematically illustrates a manufacturing process of installing power cable 31 in coiled tubing 29 while the coiled tubing is being manufactured. Forming rollers 51 deform a flat plate into a cylindrical configuration around power cable 31 in a continuous process. Then a welding device, such as a laser torch 53, welds seam 49. Power cable 31 may be oriented to position weld seam 49 outward from one of the flat sides 43, rather than at one of the corners. Placing corners 45 away from weld seam 49 increases a distance from the laser used to create weld seam. The overlapping of metal strip 42 avoids direct contact of the laser with the elastomeric jackets 41, which otherwise would create smoke. The smoke prevents effective welding of weld seam 49.

Figure 5:
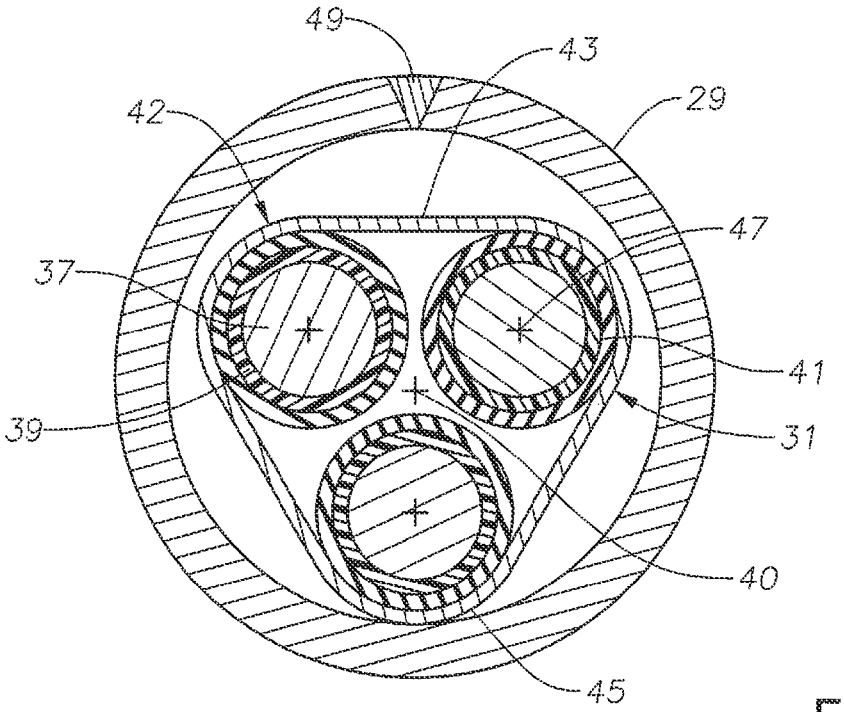
FIG. 5 is a cross sectional view of the power cable being formed in FIG. 4 taken along the line 5-5 of FIG. 4, after welding and before swaging.

As illustrated in FIGS. 4 and 5, initially, the inner diameter of coiled tubing 29 is slightly greater than the circumscribed outer diameter of power cable 31. After welding, coiled tubing 29 undergoes a swaging process with swage rollers 55 to reduce the initial diameter to a final diameter. The swaging process causes the inner diameter of coiled tubing 29 to come into tight frictional contact with power cable corners 45. Corners 45 will deform to some extent, with the deformed material being accommodated by the substantially flat sides 43. The difference in diameter in FIG. 5 is exaggerated, as the swaging process may reduce the diameter of coiled tubing 29 only about 0.100 inch.

Coiled tubing 29 is not annealed after the welding process, thus may be ready for use after the swaging process. If desired, epoxy 48 (FIG. 2) is subsequently pumped into the three channels between coiled tubing 29 and power cable 31 and allowed to cure.

While the disclosure has been shown only one of its forms, it should be apparent to those skilled in the art that it is not so limited, but is susceptible to various changes without departing from the disclosure.

The invention claimed is:

1. An assembly for supplying power to and suspending in a well an electrical well pump, the assembly comprising:

metal tubing having a cylindrical side wall;

a power cable installed within the tubing and having three insulated conductors twisted about each other along a power cable center line;

a metal strip wrapped helically around the three power conductors, the metal strip having overlapping edges, defining an exterior delta shape for the power cable when viewed in a cross-section perpendicular to the power cable center line, the delta shape having three exterior side surfaces that face radially outward relative to the power cable center line, the side surfaces joining each other at rounded corners; and wherein the rounded corners are deformed against an inner diameter of the tubing.

2. The assembly according to claim 1, wherein the side surfaces intersect each of the corners at a 60 degree angle.

3. The assembly according to claim 1, further comprising:

an adhesive material filling spaces between the metal strip and the inner diameter of the coiled tubing.

4. The assembly according to claim 1, wherein each of the power conductors comprises:

a layer of electrical insulation; and an elastomeric jacket surrounding the layer of electrical insulation.

5. The assembly according to claim 1, wherein each of the exterior side surfaces of the power cable is flat.

6. The assembly according to claim 1, wherein the delta shape in cross section defines an equilateral triangle.

7. The assembly according to claim 1, wherein:

each of the conductors has a conductor center line;

a first radial line from the power cable center line passes through the conductor center line of a first one of the conductors and through a first one of the corners;

a second radial line from the power cable center line passes through the conductor center line of a second one of the conductors and through a second one of the corners; and a third radial line from the power cable center line passes through the conductor center line of a third one of the conductors and through a third one of the corners.

8. An assembly for supplying power to and suspending in a well an electrical well pump, comprising:

a string of coiled tubing having a cylindrical side wall and a longitudinally extending weld seam in the side wall;

a power cable within the tubing, the power cable having three insulated conductors twisted around each other along a power cable center line, each of the insulated conductors being surrounded by a jacket of an elastomeric material;

a metal strip helically wrapped around the three insulated conductors, defining an equilateral triangular shape in cross-section, having three exterior side surfaces that face radially outward relative to the power cable center line, the side surfaces joining each other at rounded corners; and wherein the jacket, the conductors, and the metal strip are located in the coiled tubing with the corners deformed against an inner diameter of the coiled tubing.

9. The assembly according to claim 8, wherein:

each of the conductors has a conductor center line;

a first radial line from the power cable center line passes through the conductor center line of a first one of the conductors and through a first one of the corners;

a second radial line from the power cable center line passes through the conductor center line of a second one of the conductors and through a second one of the corners; and a third radial line from the power cable center line passes through the conductor center line of a third one of the conductors and through a third one of the corners.

10. The assembly according to claim 8, wherein each of the conductors comprises:

a layer of insulation by one of the jackets; and each of the jackets has a cylindrical shape in cross section.

11. An assembly for supplying power to and suspending in a well an electrical well pump, comprising:

a string of coiled tubing;

a power cable installed in the coiled tubing, the power cable having three insulated conductors twisted about each other along a power cable center line, the power cable having a polygonal shape in cross-section, defining a plurality of exterior side surfaces that face radially outward relative to the power cable center line, the side surfaces joining each other at rounded corners, and the side surfaces having equal widths between the corners; and wherein the corners of the power cable are deformed against an inner diameter of the coiled tubing.

12. The assembly according to claim 11, wherein the plurality of exterior side surfaces comprise three of the exterior side surfaces.

13. The assembly according to claim 11, wherein the exterior side surfaces are at 60 degree angles relative to each other.

14. The assembly according to claim 11, wherein:

each of the insulated conductors comprises a layer of electrical insulation surrounded by a jacket of an elastomeric material.

15. The assembly according to claim 11, further comprising:

an adhesive material filling spaces between the exterior side surfaces and the inner diameter of the coiled tubing.

16. The assembly according to claim 11, wherein the power cable further comprises:

a metal strip wrapped around the three conductors, the metal strip defining the exterior side surfaces.

17. The assembly according to claim 11, wherein each of the exterior side surfaces of the power cable is flat.

18. The assembly according to claim 11, wherein the polygonal shape in cross section defines an equilateral triangle.

19. The assembly according to claim 11, wherein:

each of the conductors has a conductor center line;

a first radial line from the power cable center line passes through the conductor center line of a first one of the conductors and through a first one of the corners;

a second radial line from the power cable center line passes through the conductor center line of a second one of the conductors and through a second one of the corners; and a third radial line from the power cable center line passes through the conductor center line of a third one of the conductors and through a third one of the corners.

* * * * *